US006373010B1

(12) United States Patent
Narayanan et al.

(10) Patent No.: US 6,373,010 B1
(45) Date of Patent: Apr. 16, 2002

(54) ADJUSTABLE ENERGY STORAGE MECHANISM FOR A CIRCUIT BREAKER MOTOR OPERATOR

(75) Inventors: Janakiraman Narayanan, Hosur; Mahesh Rane, Bangalore; Biranchi Narayan Sahu, Orissa; Anilkumar D. Pandit, Banglore; Kadaba V. Sridhar, Bangalore, all of (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/595,278

(22) Filed: Jun. 15, 2000

Related U.S. Application Data

(60) Provisional application No. 60/190,298, filed on Mar. 17, 2000, and provisional application No. 60/190,765, filed on Mar. 20, 2000.

(51) Int. Cl.[7] ..... H01H 23/00
(52) U.S. Cl. ..... 200/401; 335/76
(58) Field of Search ..... 200/401; 335/185–195, 335/167–176, 68–77

(56) References Cited

U.S. PATENT DOCUMENTS

| | | | |
|---|---|---|---|
| 4,611,187 | A | 9/1886 | Banfi |
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 1/1974 | Willard |
| 3,883,781 | A | 5/1975 | Cotton |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |

(List continued on next page.)

*Primary Examiner*—Lincoln Donovan
(74) *Attorney, Agent, or Firm*—Cantor Colburn LLP; Carl B. Horton

(57) ABSTRACT

An energy storage mechanism for a circuit breaker motor operator is disclosed. The energy storage mechanism has a first elastic member; a first fixture having a plurality of slots therein, the first fixture positioned in the first elastic member; a second fixture having a plurality of members defining an aperture; a second elastic member engaged to the second fixture and positioned within the aperture; wherein the second fixture is engaged to the first fixture. A motor operator for a molded case circuit breaker is disclosed. The motor operator has an energy storage mechanism for assuming a plurality of states, each state having a prescribed amount of energy stored in the energy storage mechanism; a mechanical linkage system coupled to the energy storage mechanism and to the molded case circuit breaker; wherein the molded case circuit breaker is operative to assume a plurality of positions; wherein each position of the molded case circuit breaker is associated with a corresponding state of the energy storage mechanism; a motor drive assembly connected to the mechanical linkage system for driving the energy storage mechanism from a first state of the plurality of states to a second state of the plurality of states; and an energy release mechanism coupled to the mechanical linkage system for releasing the energy stored in the energy storage mechanism wherein the energy storage mechanism returns from the second state of the plurality of states to the first state of the plurality of states.

15 Claims, 23 Drawing Sheets

U.S. PATENT DOCUMENTS 4,129,762 A 12/1978 Bruchet
4,144,513 A 3/1979 Shafer et al.
4,158,119 A 6/1979 Krakik
4,162,385 A * 7/1979 Bould et al. ..... 200/401
4,165,453 A 8/1979 Hennemann
4,166,988 A 9/1979 Ciarcia et al.
4,220,934 A 9/1980 Wafer et al.
4,255,732 A 3/1981 Wafer et al.
4,259,651 A 3/1981 Yamat
4,263,492 A 4/1981 Maier et al.
4,276,527 A 6/1981 Gerbert-Gaillard et al.
4,297,663 A 10/1981 Seymour et al.
4,301,342 A 11/1981 Castonguay et al.
4,360,852 A 11/1982 Gilmore
4,368,444 A 1/1983 Preuss et al.
4,375,021 A 2/1983 Pardini et al.
4,375,022 A 2/1983 Daussin et al.
4,376,270 A 3/1983 Staffen
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 DiMarco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,884,164 A 11/1984 Dziura et al.
4,488,133 A 12/1984 McClellan et al.
4,492,941 A 1/1985 Nagel
4,497,992 A * 2/1985 Kodera et al. ..... 200/401
4,541,032 A 9/1985 Schwab
4,546,224 A 10/1985 Mostosi
4,550,360 A 10/1985 Douherty
4,562,419 A 12/1985 Preuss et al.
4,589,052 A 5/1986 Dougherty
4,595,812 A 6/1986 Tamaru et al.
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 1/1987 Tedesco et al.
4,644,438 A 1/1987 Puccinelli et al.
4,649,247 A 3/1987 Pruess et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,713,508 A 12/1987 Baginski et al.
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al.
4,884,047 A 11/1989 Baginski et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolonegeat-Mobleu et al.
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclerq et al.
5,004,878 A 4/1991 Seymour et al.
5,029,301 A 7/1991 Nebon et al.
5,030,804 A 7/1991 Abri
5,057,655 A 10/1991 Kersusan et al.
5,077,627 A 12/1991 Fraisse
5,083,081 A 1/1992 Barrault et al.
5,095,183 A 3/1992 Raphard et al.
5,103,198 A 4/1992 Morel et al.
5,115,371 A 5/1992 Tripodi
5,120,921 A 6/1992 DiMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 3/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A 11/1993 Livesey et al.
5,262,744 A 11/1993 Arnold et al.
5,280,144 A 1/1994 Bolongeat-Mobleu et al.
5,281,776 A 1/1994 Morel et al.
5,300,907 A 1/1994 Nereau et al.
5,296,660 A 3/1994 Morel et al.
5,296,664 A 3/1994 Crookston et al.
5,298,874 A 3/1994 Morel et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.

| | | | |
|---|---|---|---|
| D367,265 | S | 2/1996 | Yamagata et al. |
| 5,493,083 | A | 2/1996 | Olivier |
| 5,504,284 | A | 4/1996 | Lazareth et al. |
| 5,504,290 | A | 4/1996 | Baginski et al. |
| 5,510,761 | A | 4/1996 | Boder et al. |
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,534,832 | A | 9/1996 | Duchemin et al. |
| 5,552,755 | A | 9/1996 | Fello et al. |
| 5,571,255 | A | 11/1996 | Baginski et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |
| 5,424,701 | A | 6/1999 | Castonguary et al. |

FOREIGN PATENT DOCUMENTS

| | | |
|---|---|---|
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 6/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 669 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner 602
458
408
316
318
604
358
420
406
430
412, 446
302
444
410
442
300
404
422
420
450

304
202
204
200
310,
312
418
402
214
210, 414
320,
322
416
214
208
206
102
140

ADJUSTABLE ENERGY STORAGE MECHANISM FOR A CIRCUIT BREAKER MOTOR OPERATOR

CROSS-REFERENCE TO RELATED APPLICATIONS

This application claims benefit of Provisional Application No. 60/190,298 filed on Mar. 17, 2000, and Provisional Application No. 60/190,765 filed on Mar. 20, 2000, the contents of which are incorporated herein by reference thereto.

BACKGROUND OF THE INVENTION

It is known in the art to provide molded case circuit breakers for electrical systems. The circuit breaker is operative to disengage the electrical system under certain operating conditions. A motor operator allows the circuit breaker to be operated remotely and to be opened, closed or reset after tripping of the circuit breaker. It is advantageous to provide a mechanism whereby a quantum of stored energy, utilized in opening, closing and resetting the circuit breaker after trip, is capable of being conveniently adjusted with a minimum of effort and without additional or special tools, either in the field or in the factor during manufacturing of the circuit breaker.

BRIEF SUMMARY OF THE INVENTION

An energy storage mechanism for a circuit breaker motor operator is disclosed. The energy storage mechanism comprises a first elastic member; a first fixture having a plurality of slots therein, the first fixture positioned in the first elastic member; a second fixture having a plurality of members defining an aperture; a second elastic member engaged to the second fixture and positioned within the aperture; wherein the second fixture is engaged to the first fixture. A motor operator for a molded case circuit breaker is disclosed. The motor operator comprises an energy storage mechanism for assuming a plurality of states, each state having a prescribed amount of energy stored in the energy storage mechanism; a mechanical linkage system coupled to the energy storage mechanism and to the molded case circuit breaker; wherein the molded case circuit breaker is operative to assume a plurality of positions; wherein each position of the molded case circuit breaker is associated with a corresponding state of the energy storage mechanism; a motor drive assembly connected to the mechanical linkage system for driving the energy storage mechanism from a first state of the plurality of states to a second state of the plurality of states; and an energy release mechanism coupled to the mechanical linkage system for releasing the energy stored in the energy storage mechanism wherein the energy storage mechanism returns from the second state of the plurality of states to the first state of the plurality of states.

DETAILED DESCRIPTION OF THE INVENTION

Figure 1:
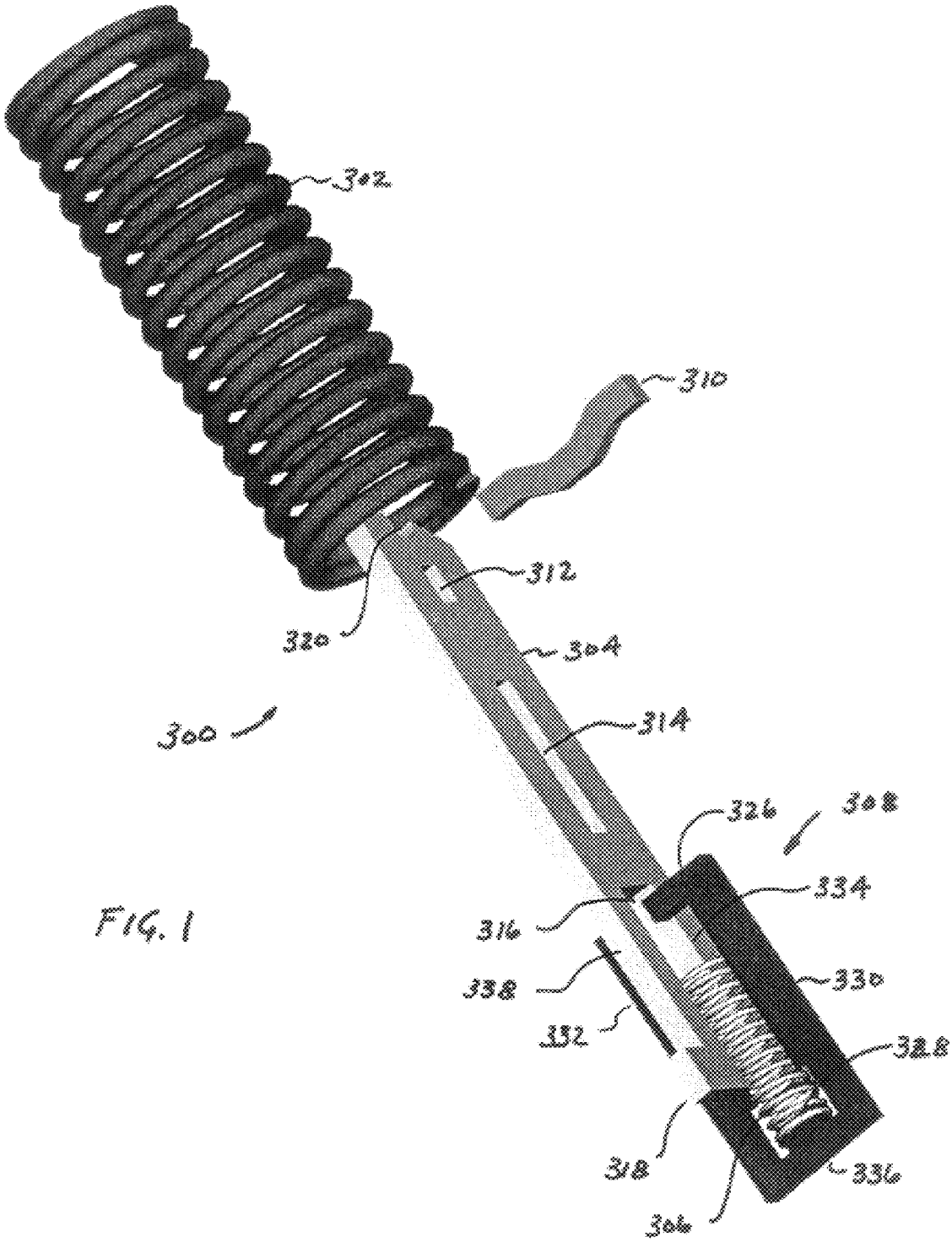
FIG. 1 is an exploded three dimensional view of the energy storage mechanism of the present invention.
Figure 2:
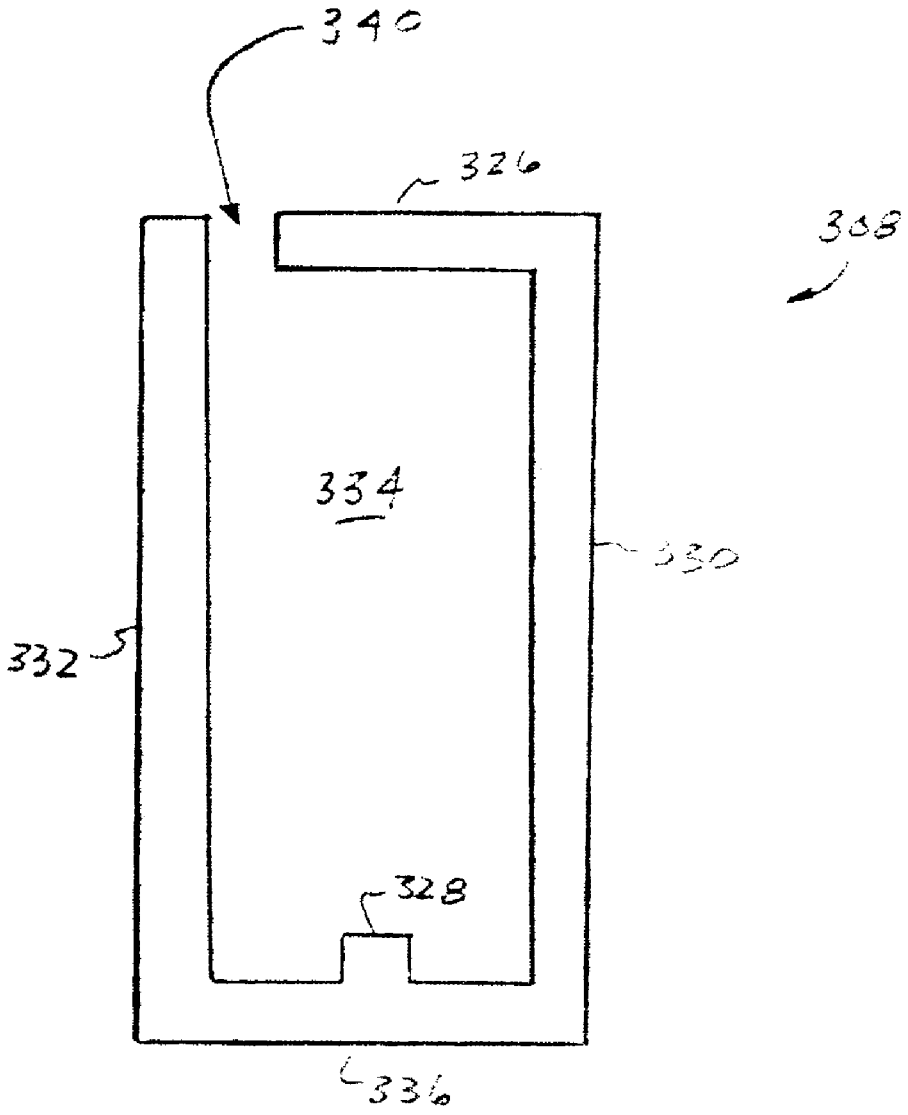
FIG. 2 is a view of the auxiliary spring guide of the energy storage mechanism of FIG. 1.
Figure 3:
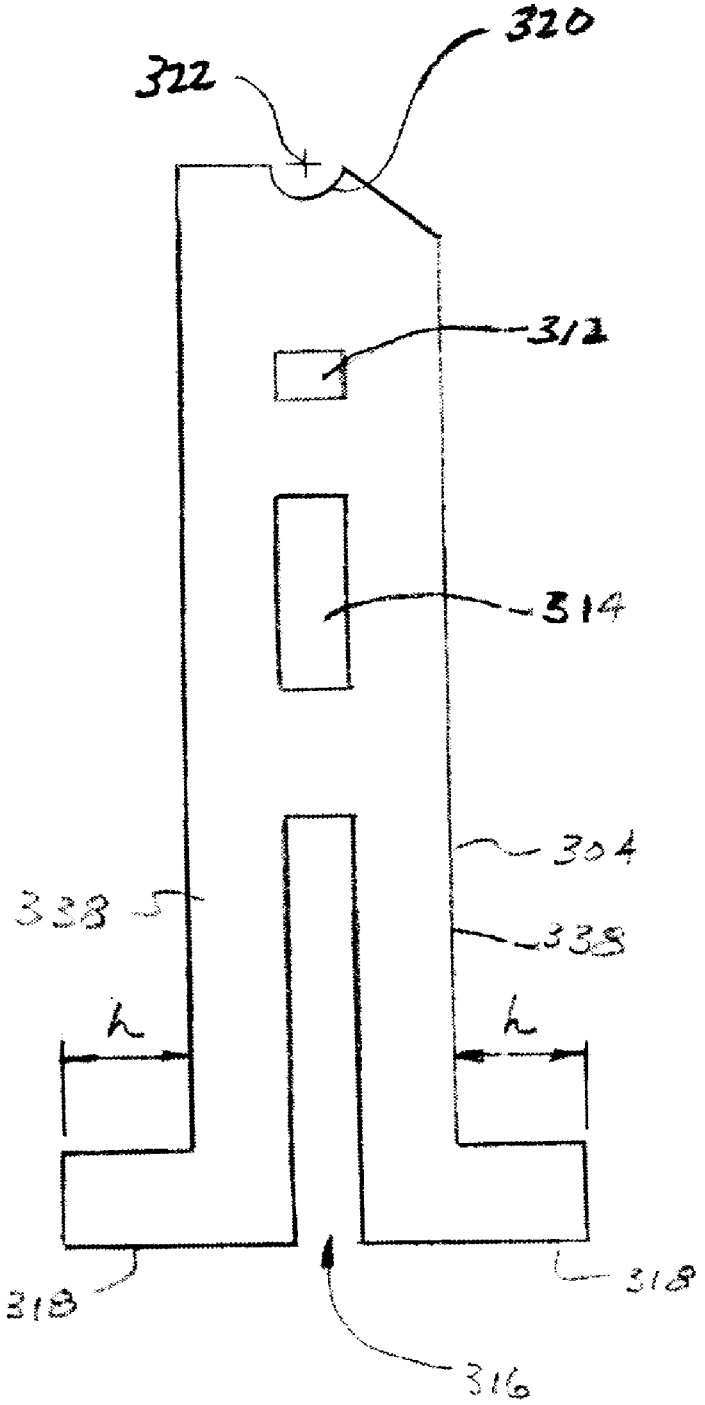
FIG. 3 is a view of the main spring guide of the energy storage mechanism of FIG. 1.
Figure 4:
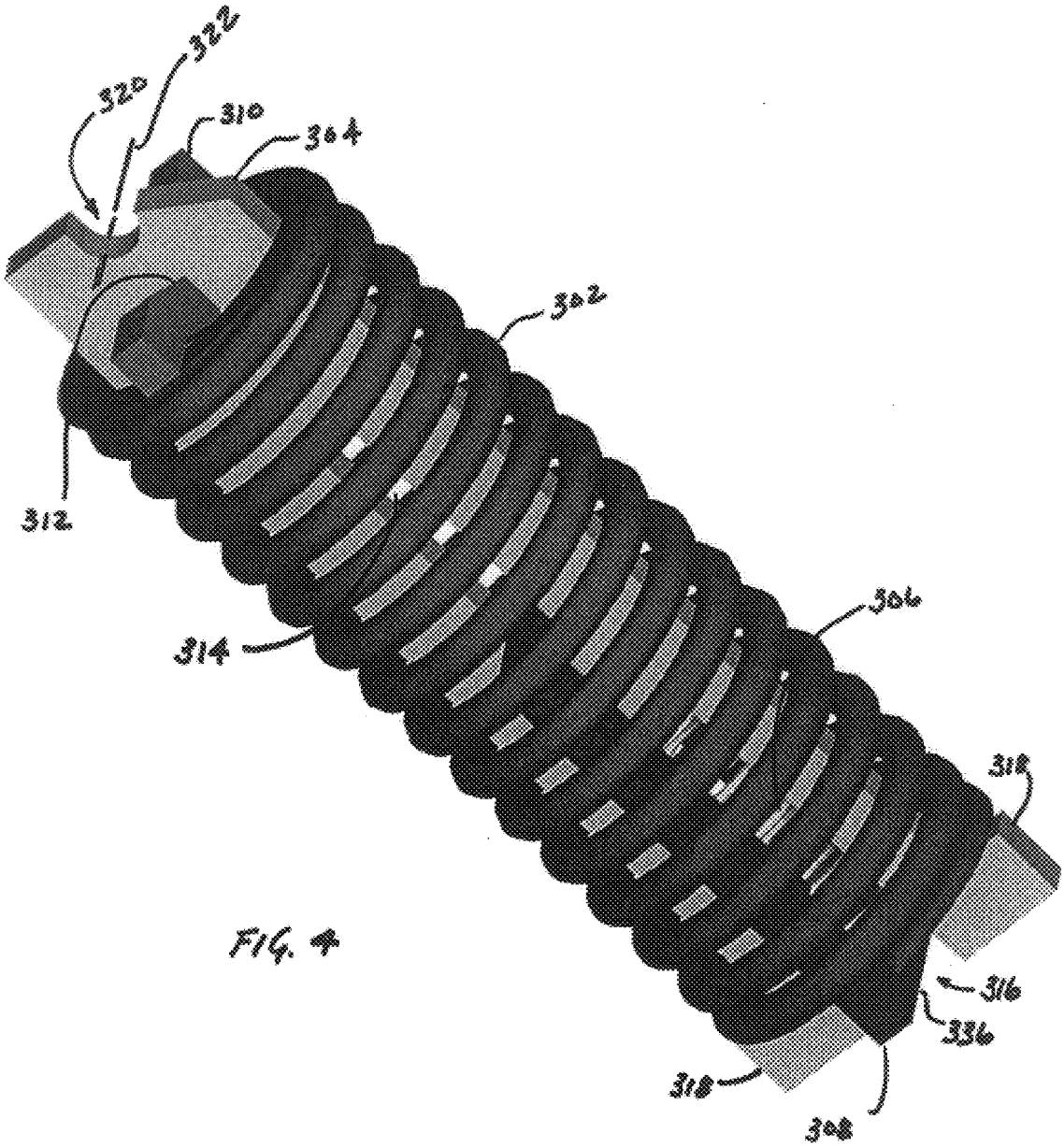
FIG. 4 is a view of the assembled energy storage mechanism of FIG. 1.
Figure 7:
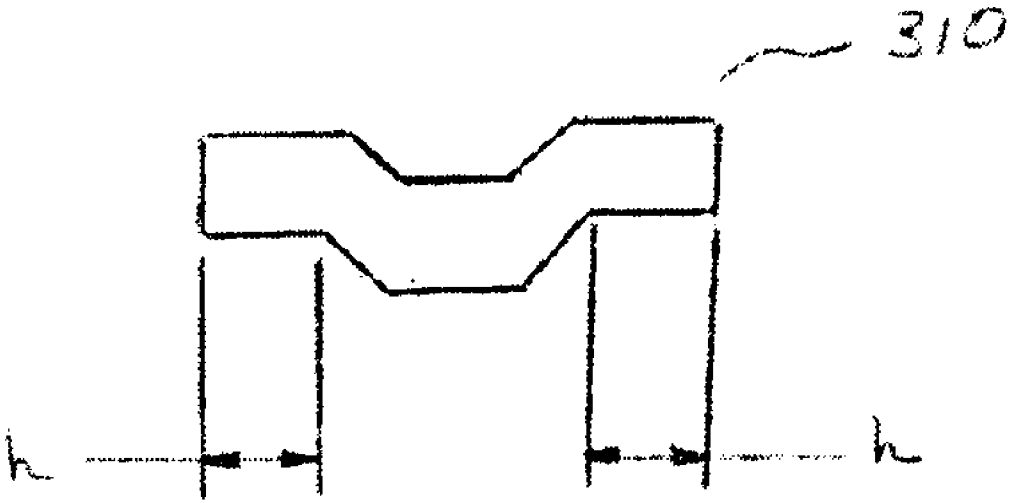
FIG. 7 is a view of the locking member of the energy storage mechanism of FIG. 1.

Referring to FIG. 1, an energy storage mechanism is shown generally at 300. The energy storage mechanism 300 comprises a main spring guide 304 (seen also in FIG. 3), a generally flat, bar-like fixture having a first closed slot 312 and a second closed slot 314 therein. The main spring guide 304 includes a semi-circular receptacle 320 at one end thereof and an open slot 316 at the opposing end. The main spring guide 304 includes a pair of flanges 318 extending outward a distance "h" (FIG. 3) from a pair of fork-like members 338 at the end of the main spring guide 304 containing the open slot 316. The pair of fork-like members 338 are generally in the plane of the main spring guide 304. The energy storage mechanism 300 further comprises an auxiliary spring guide 308. The auxiliary spring guide 308 (seen also in FIG. 2) is a generally flat fixture having a first frame member 330 and a second frame member 332 generally parallel to one another and joined by way of a base member 336. A beam member 326 extends generally perpendicular from the first frame member 330 in the plane of the auxiliary spring guide 308 nearly to the second frame member 332 so as to create a clearance 340 between the end of the beam member 326 and the second frame member 332. The clearance 340 allows the beam member 326, and thus the auxiliary spring guide 308, to engage the main spring guide 304 at the second closed slot 314. The beam member 326, the first frame member 330, the second frame member 332 and the base member 336 into the aperture 334. A tongue 328 extends from the base member 336 into the aperture 334. The tongue 328 is operative to receive an auxiliary spring 306, having a spring constant of $k_a$, whereby the auxiliary spring 306 is retained within the aperture 334. The combination of the auxiliary spring 306, retained within the aperture 334, and the auxiliary spring guide 308 is coupled to the main spring guide 304 in such a manner that the beam member 326 is engaged with, and allowed to move along the length of, the second closed slot 314. The auxiliary spring guide 308 is thereby allowed to move relative to the main spring guide 304 by the application of a force to the base member 336 of the auxiliary spring guide 308. The auxiliary spring 306 is thus retained simultaneously within the open slot 316 by the fork-like members 338 and the in aperture 334 by the first frame member 330 and second frame member 332. The energy storage mechanism 300 further comprises a main spring 302 having a spring constant $k_m$. The main spring guide 304, along with the auxiliary spring guide 308 and the auxiliary spring 306 engaged thereto, is positioned within the interior part of the main spring 302 such that one end of the main spring 302 abuts the flanges 318. A locking pin 310 (FIG. 7) is passed through the first closed slot 312 such that the opposing end of the main spring 302 abuts the locking pin 310 so as to capture and lock the main spring 302 between the locking pin 310 and the flanges 318. As seen in FIG. 4 the assembled arrangement of the main spring 302, the main spring guide 304, the auxiliary spring 306, the auxiliary spring guide 308 and the locking pin 310 form a cooperative mechanical unit. In the interest of clarity in the description of the energy storage mechanism 300 in FIGS. 1 and 4, reference is made to FIGS. 2 and 3 showing the auxiliary spring guide 308 and the main spring guide 304 respectively.

Figure 5:
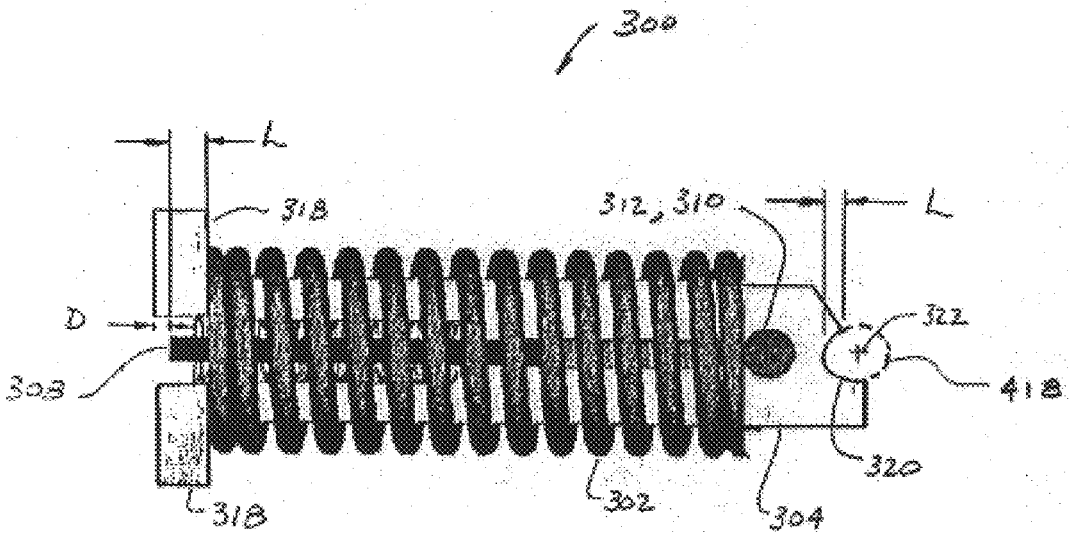
FIG. 5 is a view of the assembled energy storage mechanism of FIG. 1 showing the movement of the auxiliary spring guide relative to the main spring guide and the assembled energy storage mechanism engaged to a side plate pin.
Figure 5A:
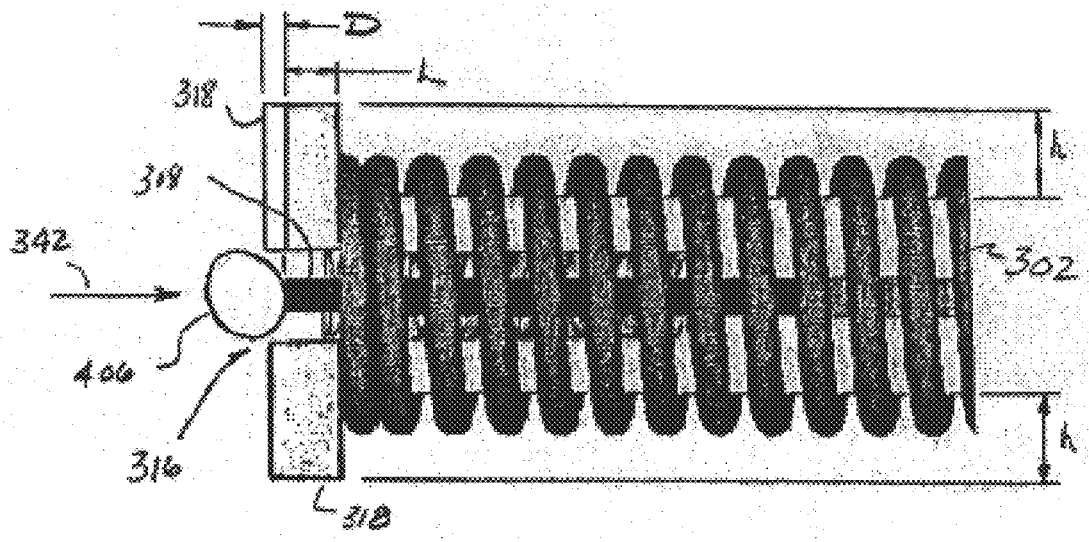
FIG. 5A is a more detailed view of a segment of the assembled energy storage mechanism of FIG. 5 showing the assembled energy storage mechanism engaged to a drive plate pin.

Reference is now made to FIGS. 5 and 5A. FIG. 5 depicts the assembled energy storage mechanism 300. A side plate pin 418, affixed to a side plate (not shown), is retained within the receptacle 320 so as to allow the energy storage mechanism 300 to rotate about a spring assembly axis 322. In FIG. 5A, a drive plate pin 406, affixed to a drive plate (not shown), is retained against the auxiliary spring guide 308 and between the fork-like members 338 in the end of the main spring guide 304 containing the open slot 316. The drive plate pin 406 is so retained in the open slot 316 at an initial displacement "D" with respect to the ends of the flanges 318. Thus, as seen in FIGS. 5 and 5A, the assembled energy storage mechanism 300 is captured between the side plate pin 418, the drive plate pin 406, the receptacle 320 and the open slot 316. The energy storage mechanism 300 is held firmly therebetween due to the force of the auxiliary spring 306 acting against the auxiliary spring guide 308, against the drive plate pin 406, against the main spring guide 304 and against the side plate pin 418. As seen in FIG. 5, the auxiliary spring guide 308 is operative to move independent of the main spring 302 over a distance "L" relative to the main spring guide 304 by the application of a force acting along the line 342 in FIG. 5A. When the auxiliary spring guide 308 has traversed the distance "L," the side plate pin 418 comes clear of the receptacle 320 and the energy storage mechanism 300 may be disengaged from the side plate pin 418 and the drive plate pin 406.

As best understood from FIGS. 5 and 5A, the spring constant, $k_a$, for the auxiliary spring 306 is sufficient to firmly retain the assembled energy storage mechanism 300 between the side plate pin 418 and the drive plate pin 406, but also such that only a minimal amount of effort is required to compress the auxiliary spring 306 and allow the auxiliary spring guide 308 to move the distance "L." This allows the energy storage mechanism 300 to be easily removed by hand from between the side plate pin 418 and the drive plate pin 406.

Figure 6:
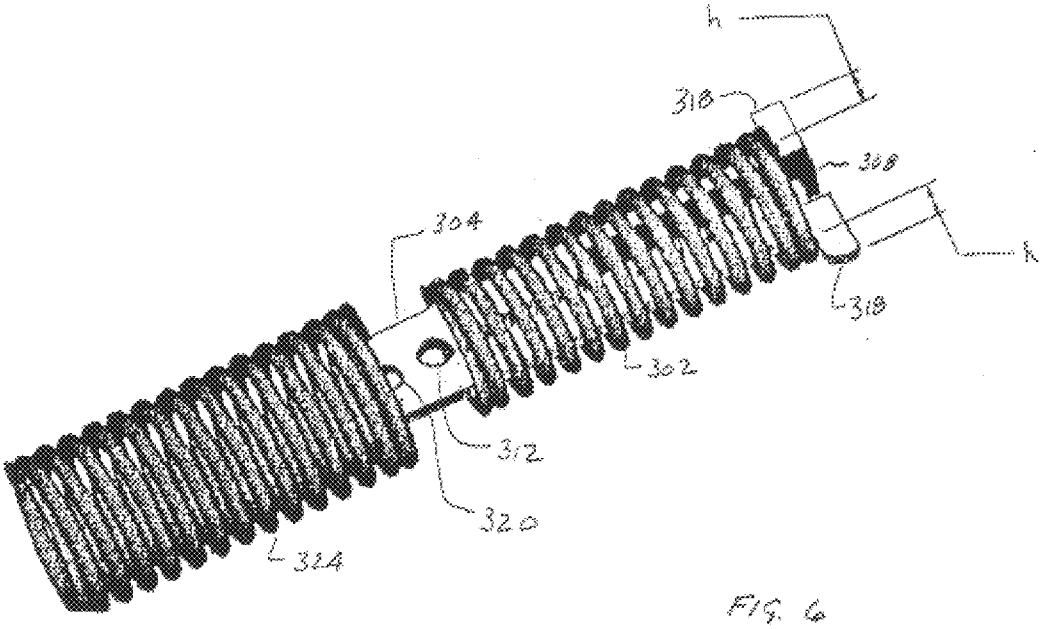
FIG. 6 is a three dimensional view of the energy storage mechanism of FIG. 1 including a second spring, coaxial with the main spring of FIG. 1.

Referring to FIG. 6, a coaxial spring 324, having a spring constant $k_c$ and aligned coaxial with the main spring 302, is shown. The coaxial spring 324 may be engaged to the main spring guide 304 between the flanges 318 and the locking pin 310 (not shown) in the same manner depicted in FIG. 4 for the main spring 302, thus providing the energy storage mechanism 300 with a total spring constant of $k_T=k_m+k_c$. The flanges 318 extend a distance "h" sufficient to accommodate the main spring 302 and the coaxial spring 324.

Thus, the energy storage mechanism 300 of the present invention is a modular unit that can be easily removed and replaced in the field or in the factor with a new or additional main spring 302. This allows for varying the amount of energy that can be stored in the energy storage mechanism 300 without the need for special or additional tools.

Figure 20:
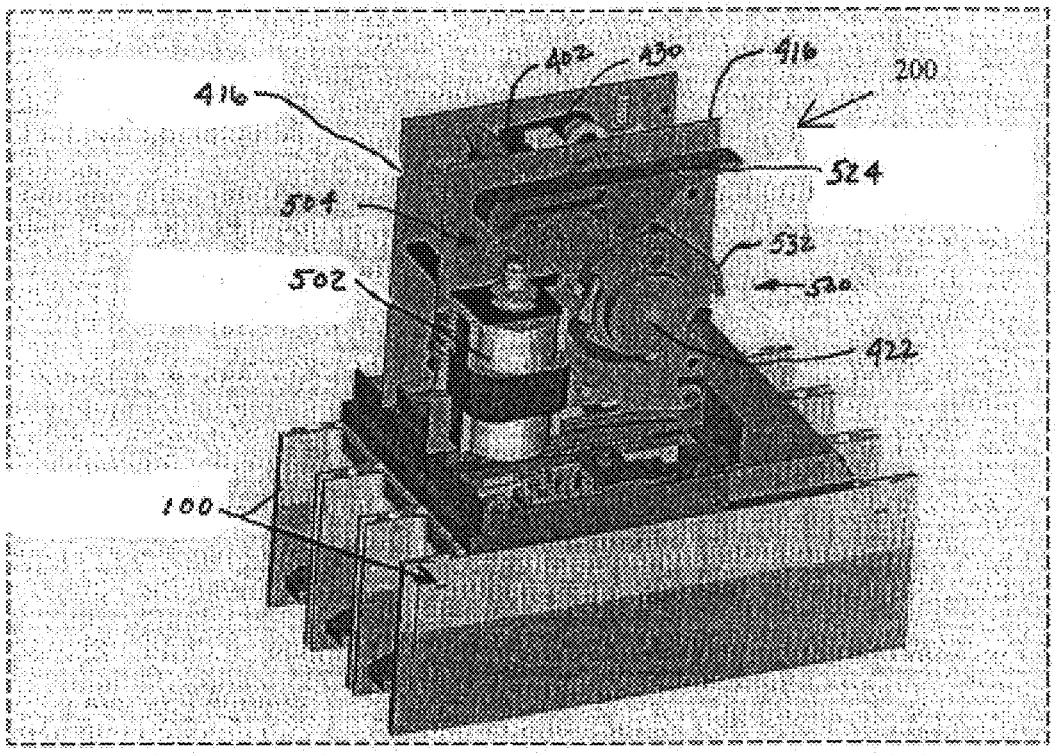
FIG. 20 is a three dimensional view of the circuit breaker motor operator of FIG. 8 including the motor drive assembly.
Figure 21:
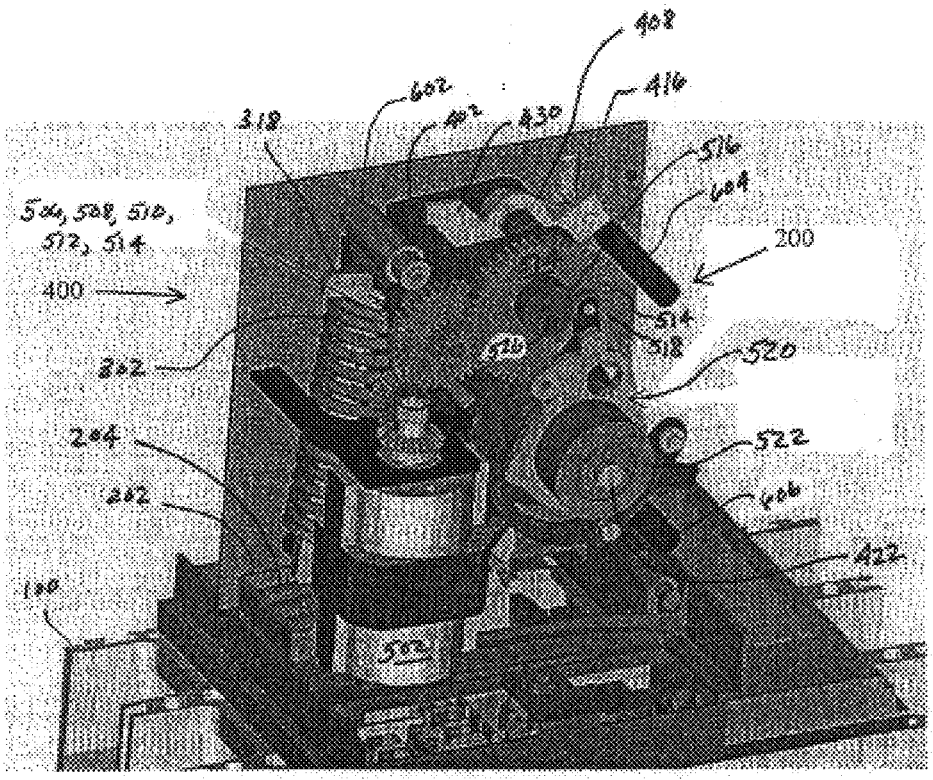
FIG. 21 is a three dimensional view of the circuit breaker motor operator of FIG. 8, excluding a side plate.

Referring to FIGS. 8–13C, a molded case circuit breaker (MCCB) is shown generally at 100. The molded case circuit breaker 100 includes a circuit breaker handle 102 extending therefrom which is coupled to a set of circuit breaker contacts (not shown). The components of the circuit breaker motor operator of the present invention are shown in FIGS. 8–13C generally at 200. The motor operator 200 generally comprises a holder, such as a slidable carriage 202 coupled to the circuit breaker handle 102, the energy storage mechanism 300, as described above, and a mechanical linkage system 400. The mechanical linkage system 400 is connected to the energy storage mechanism 300, the slidable carriage 202 and a motor drive assembly 500 (FIGS. 20 and 21). The slidable carriage 202, the energy storage mechanism 300 and the mechanical linkage system 400 act as a cooperative mechanical unit responsive to the action of the motor drive assembly 500 and the circuit breaker handle 102 to assume a plurality of configurations. In particular, the action of the motor operator 200 is operative to disengage or reengage the set of circuit breaker contacts coupled to the circuit breaker handle 102. Disengagement (i.e., opening) of the set of circuit breaker contacts interrupts the flow of electrical current through the molded case circuit breaker 100, as is well known. Reengagement (i.e., closing) of the circuit breaker contacts allows electrical current to flow through the molded case circuit breaker 100, as is well known.

Figure 8:
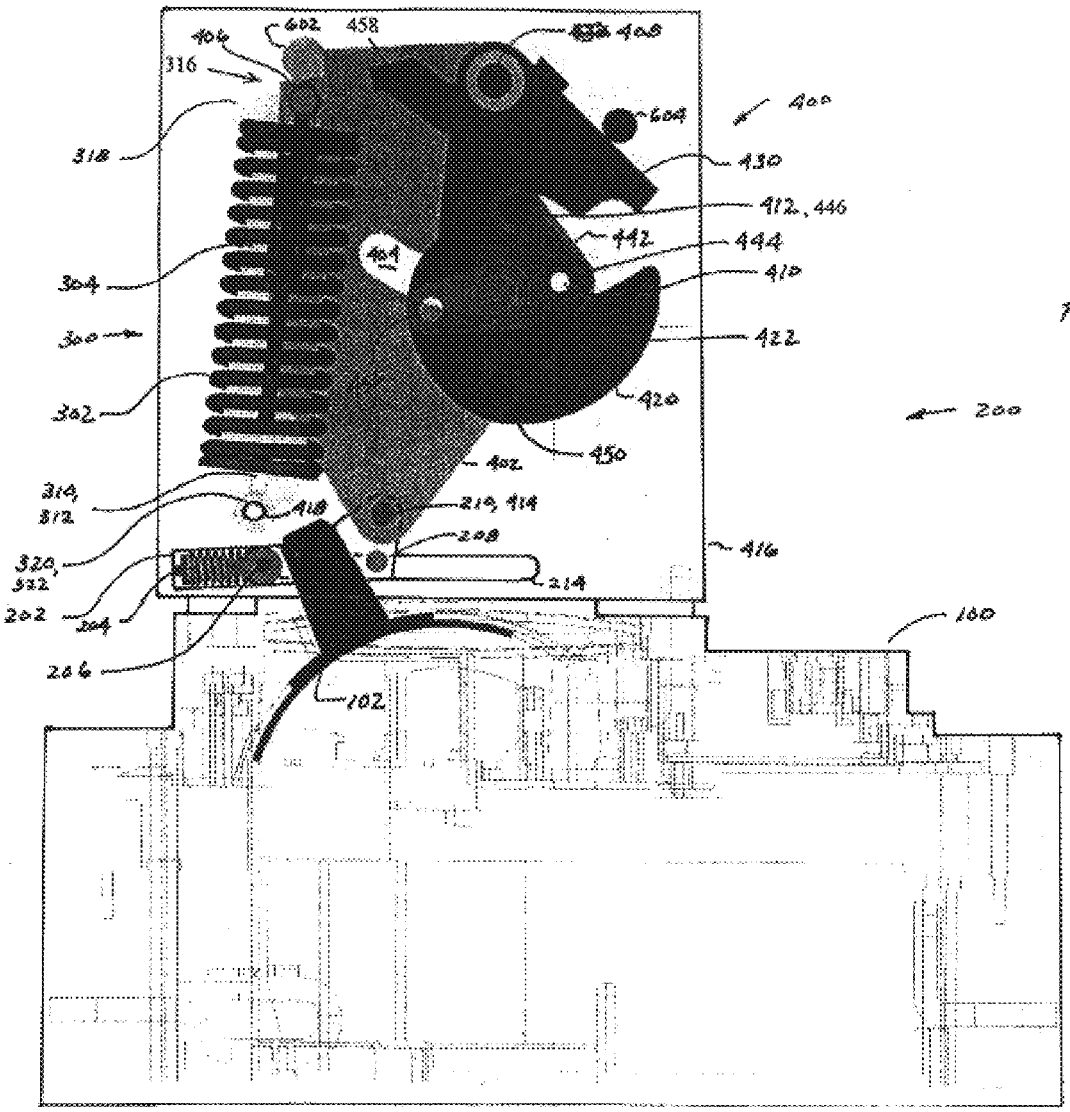
FIG. 8 is a side view of the circuit breaker motor operator of the present invention in the CLOSED position.
Figure 13A:
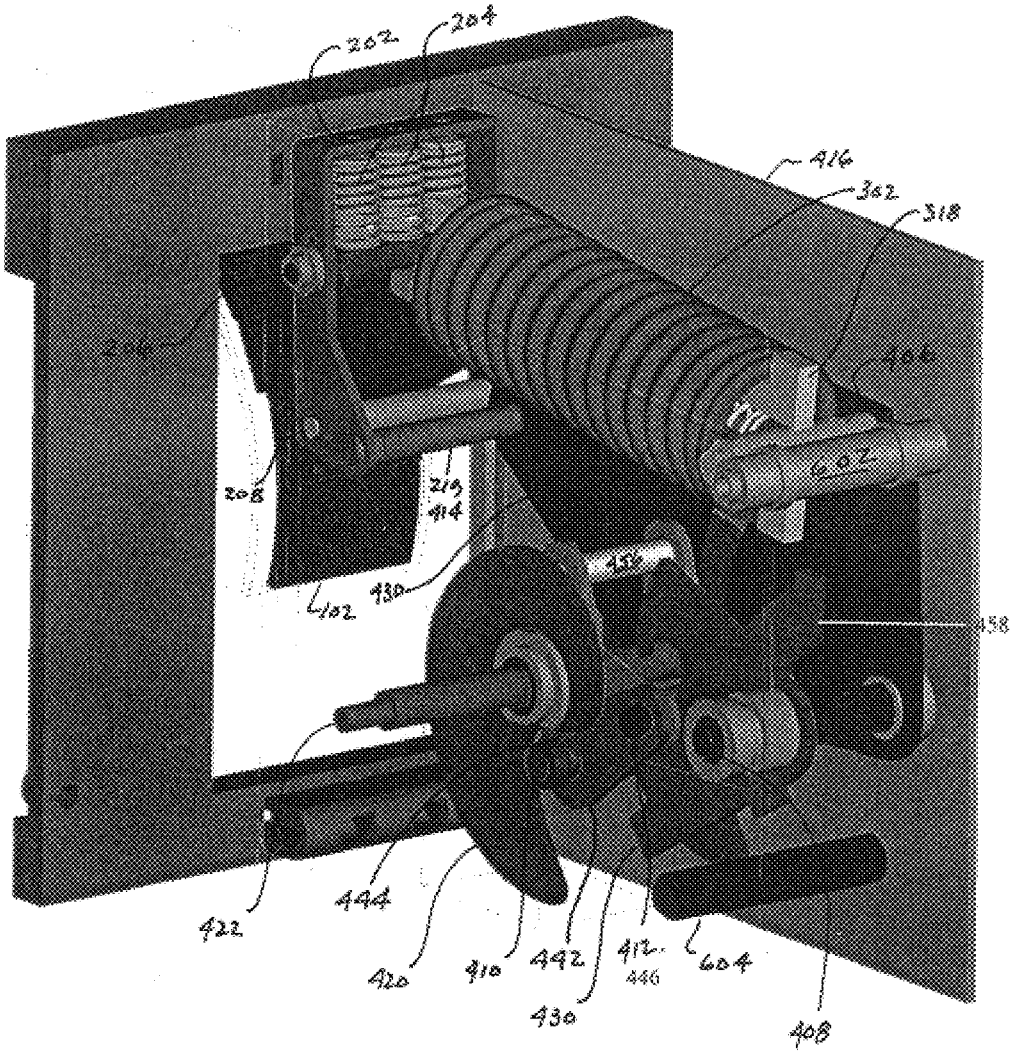
FIG. 13A is a first three dimensional view of the circuit breaker motor operator of FIG. 8.
Figure 13B:
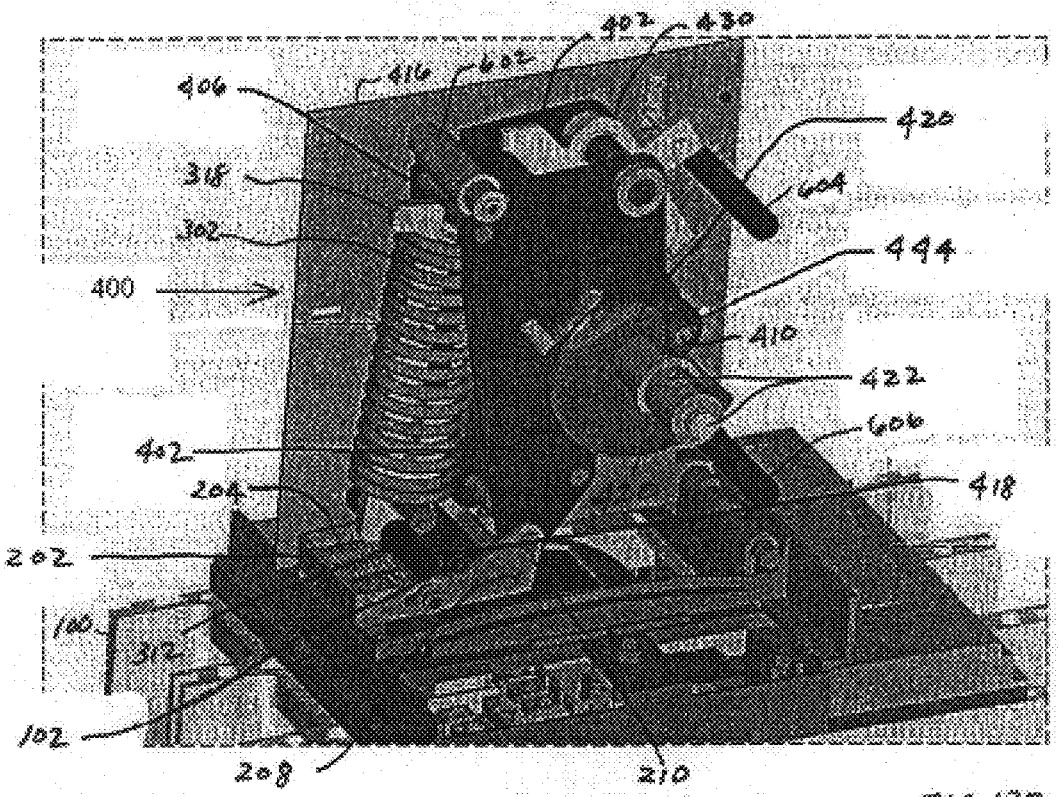
FIG. 13B is s second three dimensional view of the circuit breaker motor operator of FIG. 8.
Figure 13C:
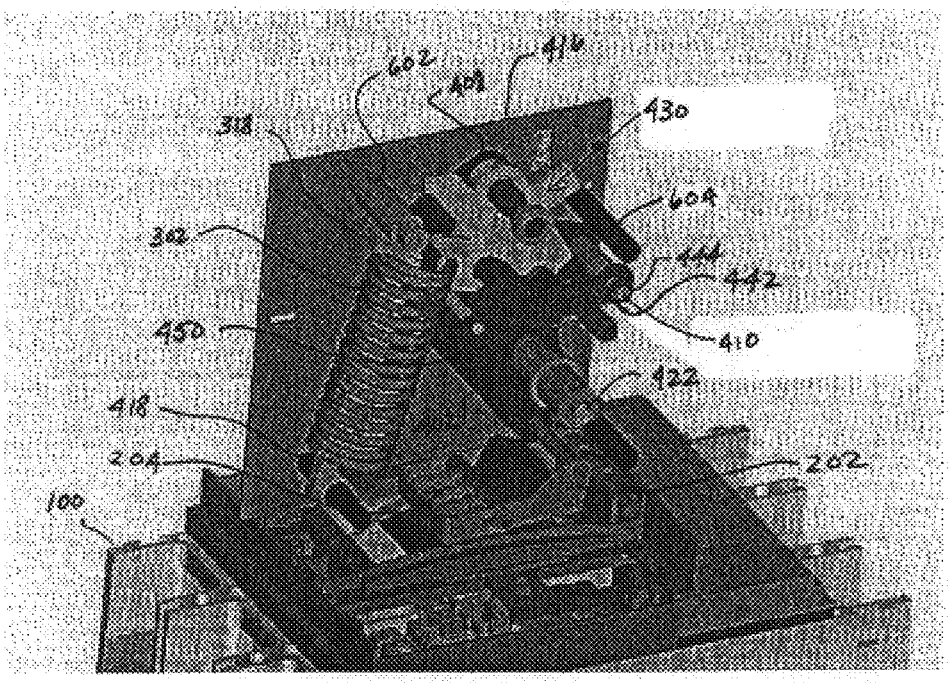
FIG. 13C is a third three dimensional view of the circuit breaker motor operator of FIG. 8.
Figure 14:
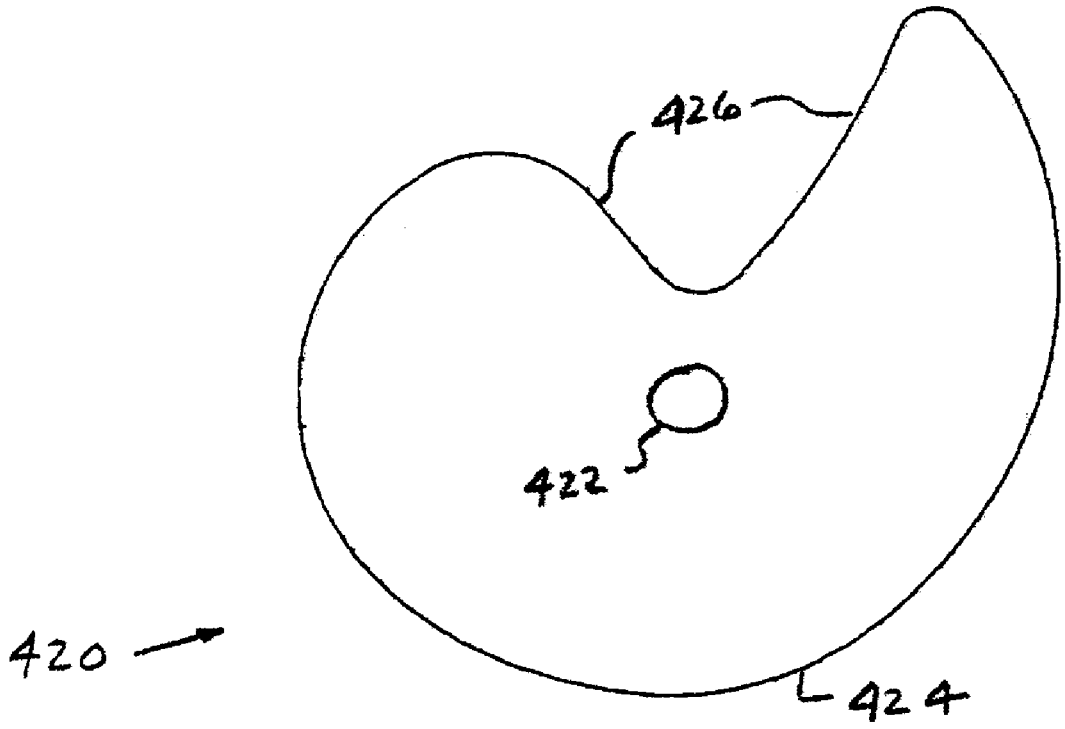
FIG. 14 is a view of the cam of the circuit breaker motor operator of FIG. 8.
Figure 15:
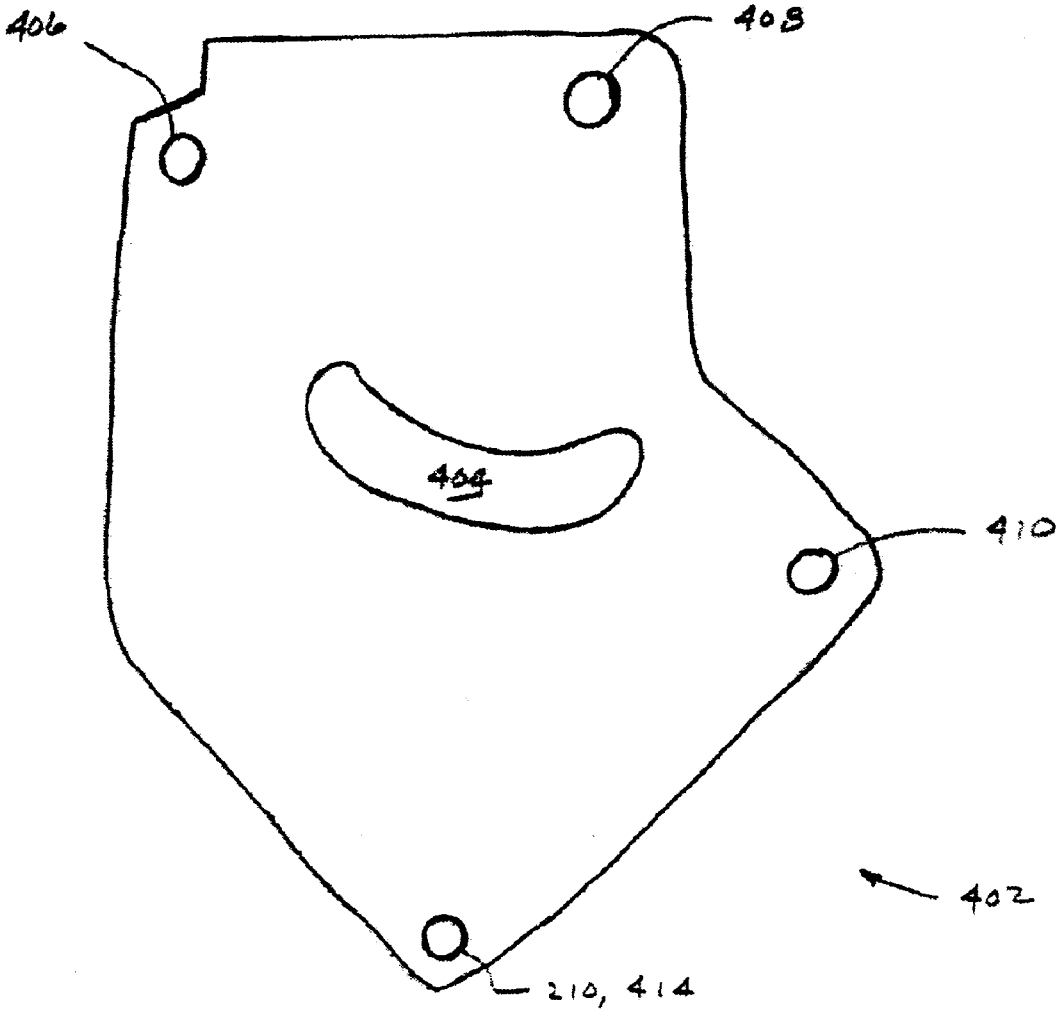
FIG. 15 is a view of the drive plate of the circuit breaker motor operator of FIG. 8.

More particularly in FIG. 8, in conjunction with FIGS. 13A, 13B and 13C, the mechanical linkage system 400 comprises a pair of side plates 416 held substantially parallel to one another by a set of braces 602, 604 and connected to the molded case circuit breaker 100. A pair of drive plates 402 (FIG. 15) are positioned interior, and substantially parallel to the pair of side plates 416. The drive plates 402 are connected to one another by way of, and are rotatable about, a drive plate axis 408. The drive plate axis 408 is connected to the pair of side plates 416. The pair of drive plates 402 include a drive plate pin 406 connected therebetween and engaged to the energy storage mechanism 300 at the open slot 316 of the main spring guide 304. A connecting rod 414 connects the pair of the drive plates 402 and is rotatably connected to the slidable carriage 202 at axis 210. A cam 420, rotatable on a cam shaft 422, includes a first cam surface 424 and a second cam surface 426 (FIG. 14). The cam 420 is, in general, of a nautilus shape wherein the second cam surface 426 is a concavely arced surface and the first cam surface 424 is a convexly arced surface. The cam shaft 422 passes through a slot 404 in each of the pair of drive plates 402 and is supported by the pair of side plates 416. The cam shaft 422 is further connected to the motor drive assembly 500 (FIGS. 20 and 21) from which the cam 420 is driven in rotation.

Figure 16:
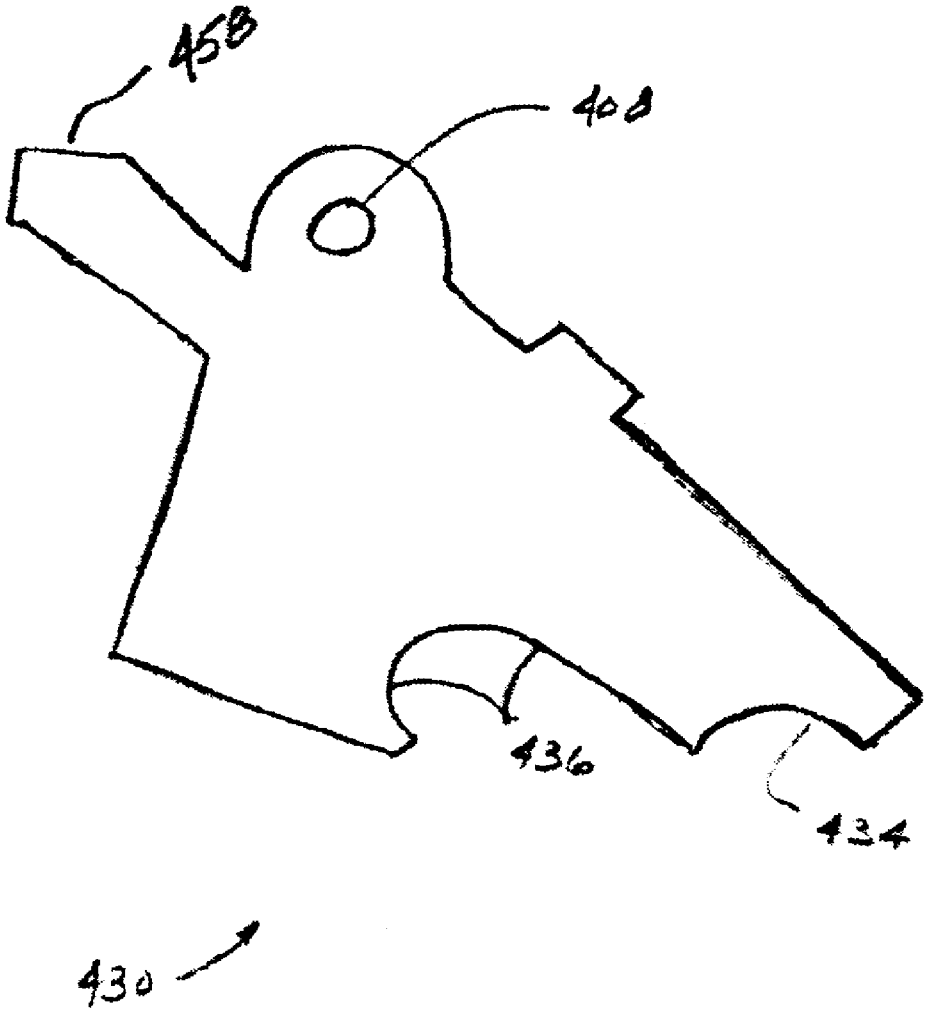
FIG. 16 is a view of the latch plate of the circuit breaker motor operator of FIG. 8.
Figure 17:
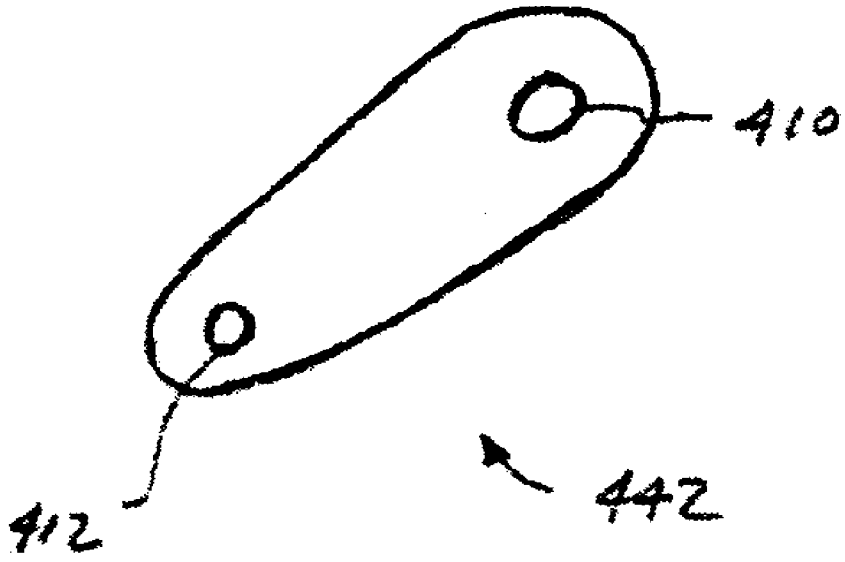
FIG. 17 is a view of the first latch link of the circuit breaker motor operator of FIG. 8.
Figure 18:
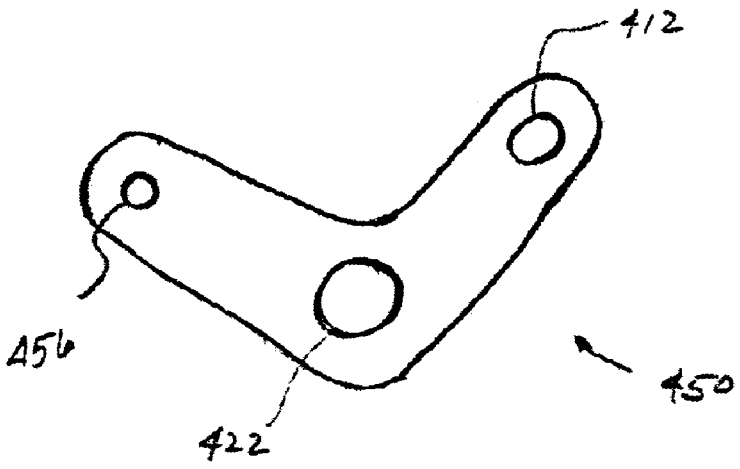
FIG. 18 is a view of the second latch link of the circuit breaker motor operator of FIG. 8.
Figure 19:
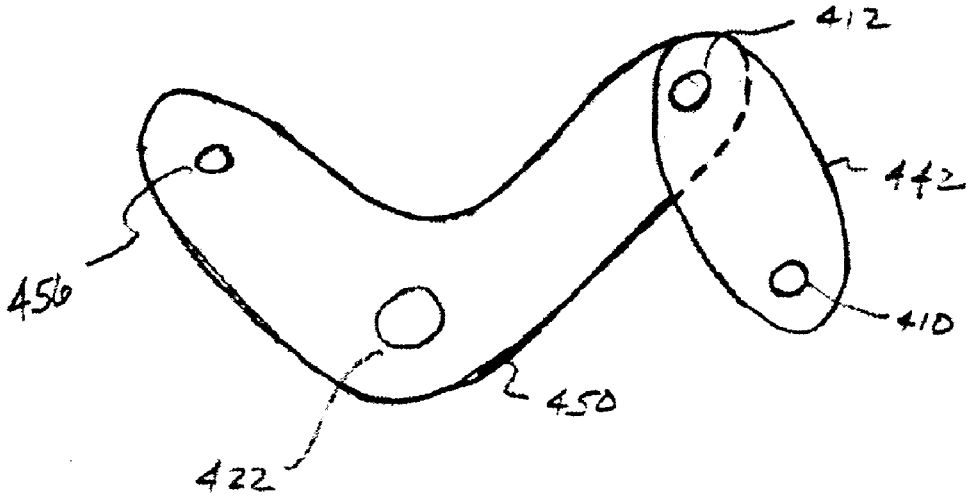
FIG. 19 is a view of the connection of the first and second latch links of the circuit breaker motor operator of FIG. 8.

A pair of first latch links 442 (FIG. 17) are coupled to a pair of second latch links 450 (FIG. 18), about a link axis 412 (FIG. 19). The second latch link 450 is also rotatable about the cam shaft 422. The first latch links 442 and the second latch links 450 are interior to and parallel with the drive plates 402. A roller 444 is coupled to a roller axis 410 connecting the first latch links 442 to the drive plate 402. The roller 444 is rotatable about the roller axis 410. The roller axis 410 is connected to the drive plates 402 and the roller 444 abuts, and is in intimate contact with, the second cam surface 426 of the cam 420. A brace 456 connects the pair of second latch links 450. An energy release mechanism, such as a latch plate 430 (FIG. 16), is rotatable about the drive plate axis 408 and is in intimate contact with a rolling pin 446 rotatable about the link axis 412. The rolling pin 446 moves along a first concave surface 434 and a second concave surface 436 (FIG. 16) of the latch plate 430. The first concave surface 434 and the second concave surface 436 of the latch plate 430 are arc-like, recessed segments along the perimeter of the latch plate 430 operative to receive the rolling pin 446 and allow the rolling pin 446 to be seated therein as the latch plate 430 rotates about the drive plate axis 408. The latch plate 430 includes a releasing lever 458 to which a force may be applied to rotate the latch plate 430 about the drive plate axis 408. In FIG. 8, the latch plate 430 is also in contact with the brace 604.

The slidable carriage 202 is connected to the drive plate 402 by way of the connecting rod 414 of axis 210 and is rotatable thereabout. The slidable carriage 202 comprises a set of retaining springs 204, a first retaining bar 206 and a second retaining bar 208. The retaining springs 204, disposed within the slidable carriage 202 and acting against the first retaining bar 206, retain the circuit breaker handle 102 firmly between the first retaining bar 206 and the second retaining bar 208. The slidable carriage 202 is allowed to move laterally with respect to the side plates 416 by way of the first retaining bar 206 coupled to a slot 214 in each of the side plates 416. The slidable carriage 202 moves back and forth along the slots 214 to toggle the circuit breaker handle 102 back and forth between the position of FIG. 8 and that of FIG. 12.

In FIG. 8, the molded case circuit breaker 100 is in the closed position (i.e., electrical contacts closed) and no energy is stored in the main spring 302. The motor operator 200 operates to move the circuit breaker handle 102 between the closed position of FIG. 8 and the open position (i.e., electrical contacts open) of FIG. 12. In addition, when the molded case circuit breaker 100 trips due for example to an overcurrent condition in an associated electrical system, the motor operator 200 operates to reset an operating mechanism (not shown) within circuit breaker 100 by moving the handle to the open position of FIG. 12.

Figure 9:
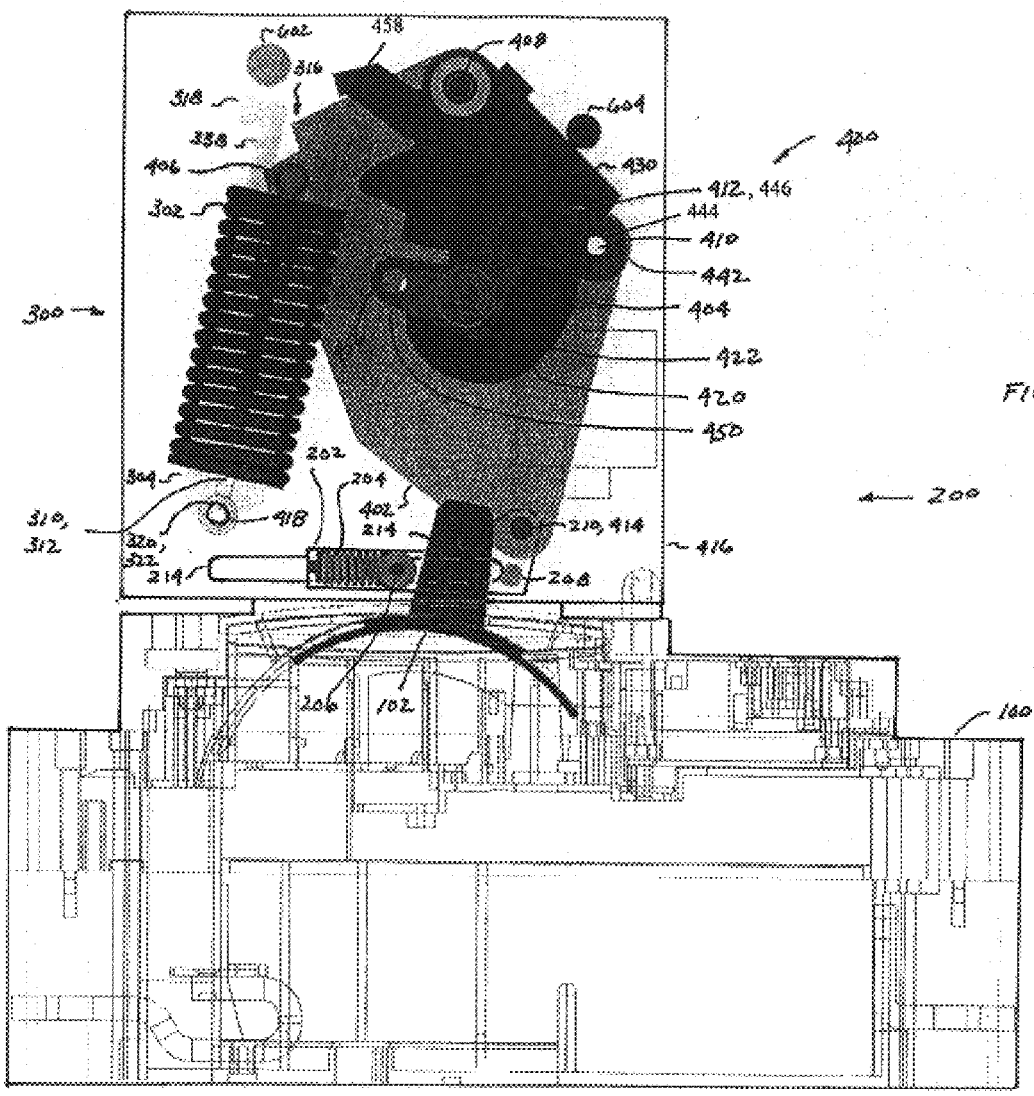
FIG. 9 is a side view of the circuit breaker motor operator of FIG. 8 passing from the closed position of FIG. 8 to the OPEN position.
Figure 10:
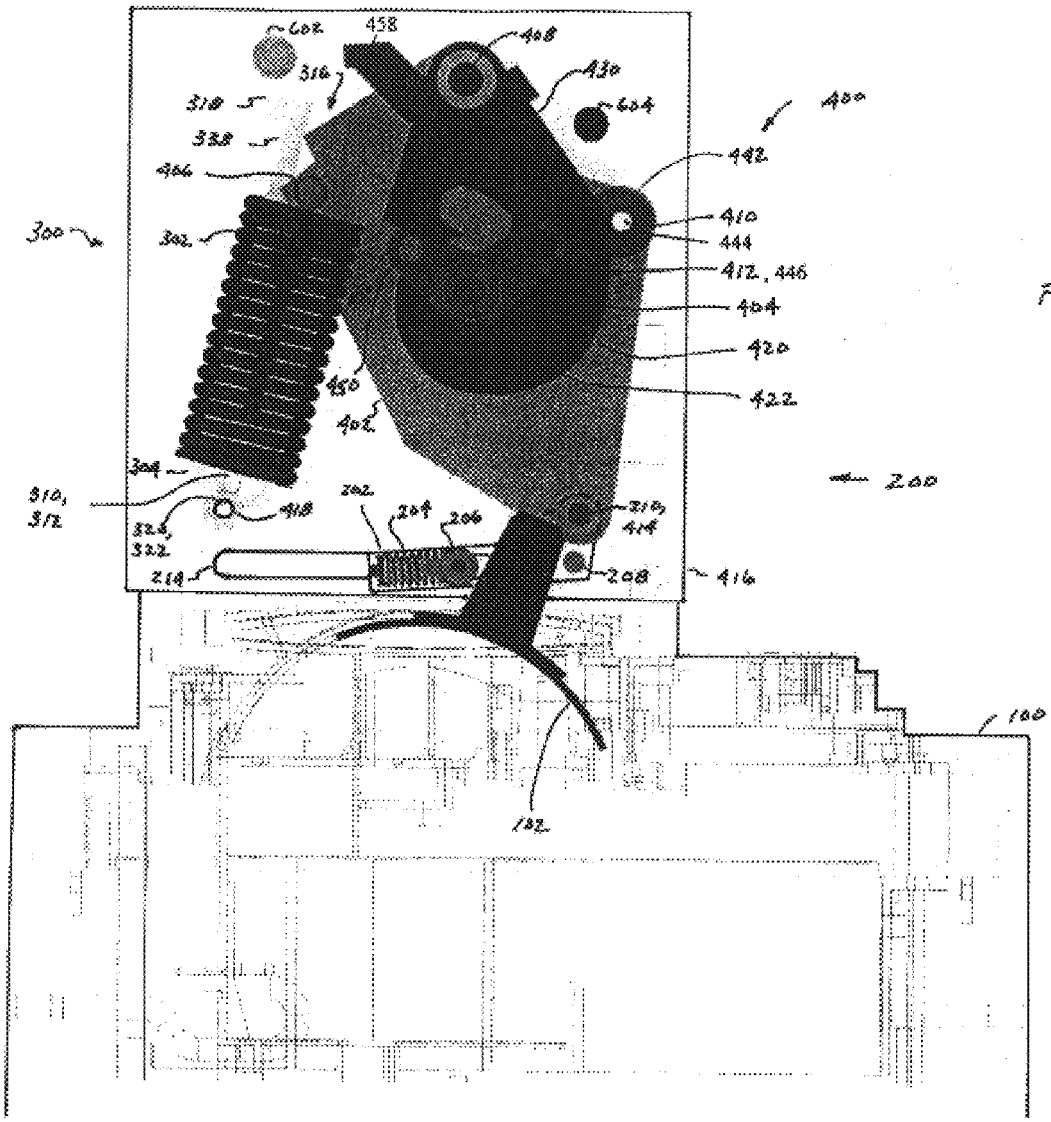
FIG. 10 is a side view of the circuit breaker motor operator of FIG. 8 passing from the closed position of FIG. 8 to the OPEN position.
Figure 11:
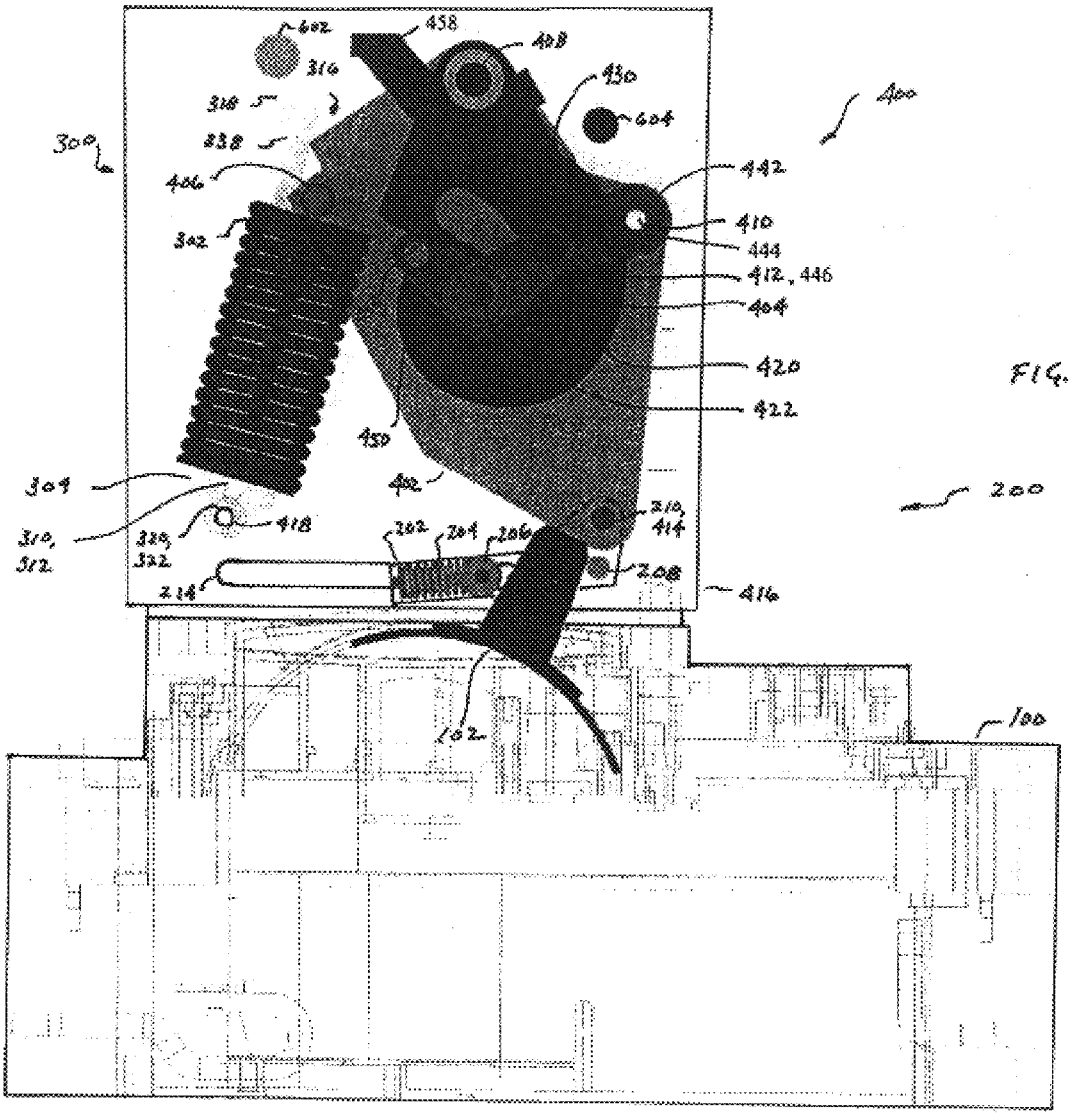
FIG. 11 is a side view of the circuit breaker motor operator of FIG. 8 passing from the closed position of FIG. 8 to the OPEN position.
Figure 12:
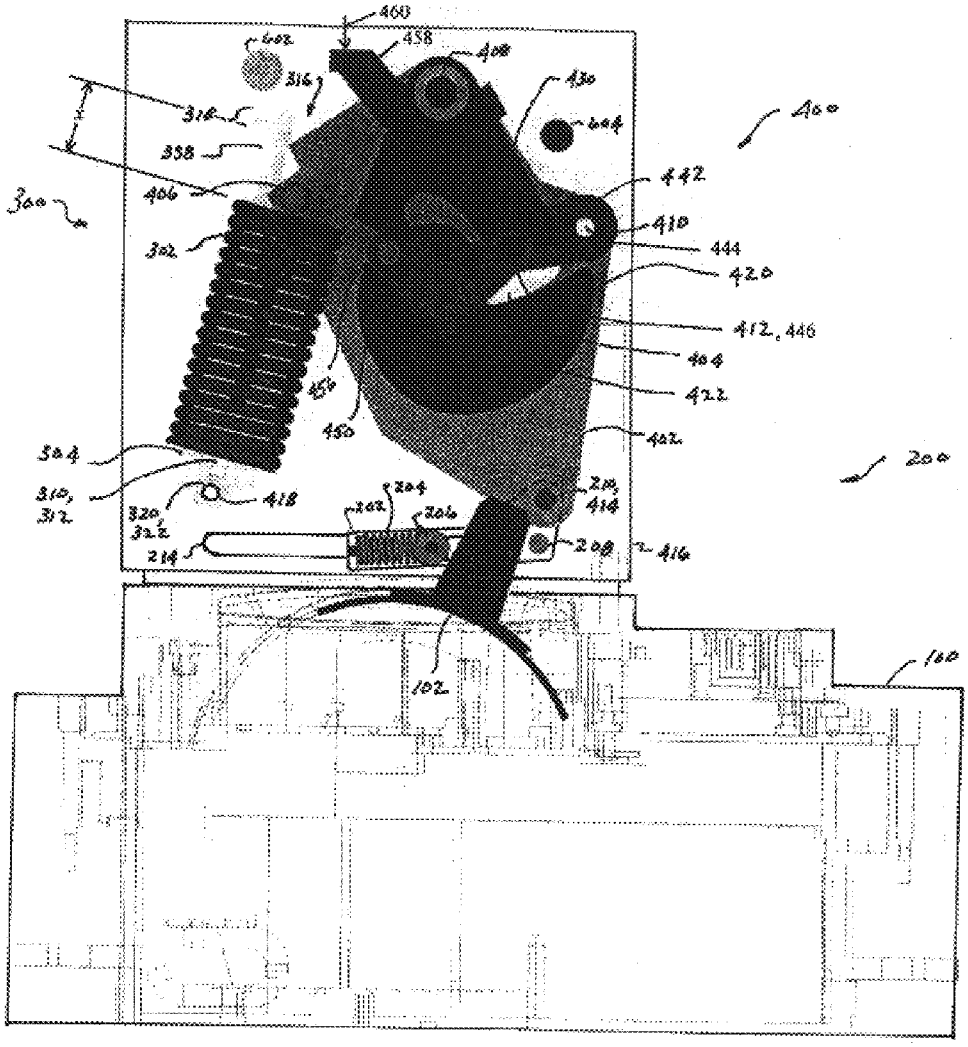
FIG. 12 is a side view of the circuit breaker motor operator of FIG. 8 in the OPEN position.

To move the handle from the closed position of FIG. 8 to the open position of FIG. 12, the motor drive assembly 500 rotates the cam 420 clockwise as viewed on the cam shaft 422 such that the mechanical linkage system 400 is sequentially and continuously driven through the configurations of FIGS. 9, 10 and 11. Referring to FIG. 9, the cam 420 rotates clockwise about the cam shaft 422. The drive plates 402 are allowed to move due to the slot 404 in the drive plates 402. The roller 444 on the roller axis 410 moves along the first cam surface 424 of the cam 420. The counterclockwise rotation of the drive plates 402 drives the drive plate pin 406 along the open slot 316 thereby compressing the main spring 302 and storing energy therein. The energy storage mechanism 300 rotates clockwise about the spring assembly axis 322 and the side plate pin 418. The latch plate 430, abutting the brace 604, remains fixed with respect to the side plates 416.

Referring to FIG. 10, the drive plate 402 rotates further counterclockwise causing the drive plate pin 406 to further compress the main spring 302. The cam 420 continues to rotate clockwise. The rolling pin 446 moves from the second concave surface 436 of the latch plate 430 partially to the first concave surface 434 and the latch plate 430 rotates clockwise away from the brace 604. The drive plate pin 406 compresses the main spring 302 further along the open slot 316.

In FIG. 11 the latch plate 430 rotates clockwise until the rolling pin 446 rests fully within the first concave surface 434. The roller 444 remains in intimate contact with the first cam surface 424 as the cam 420 continues to turn in the clockwise direction. In FIG. 12 the cam 420 has completed its clockwise rotation and the roller 44 is disengaged from the cam 420. The rolling pin 446 remains in contact with the first concave surface 434 of the latch plate 430.

Figure 23:
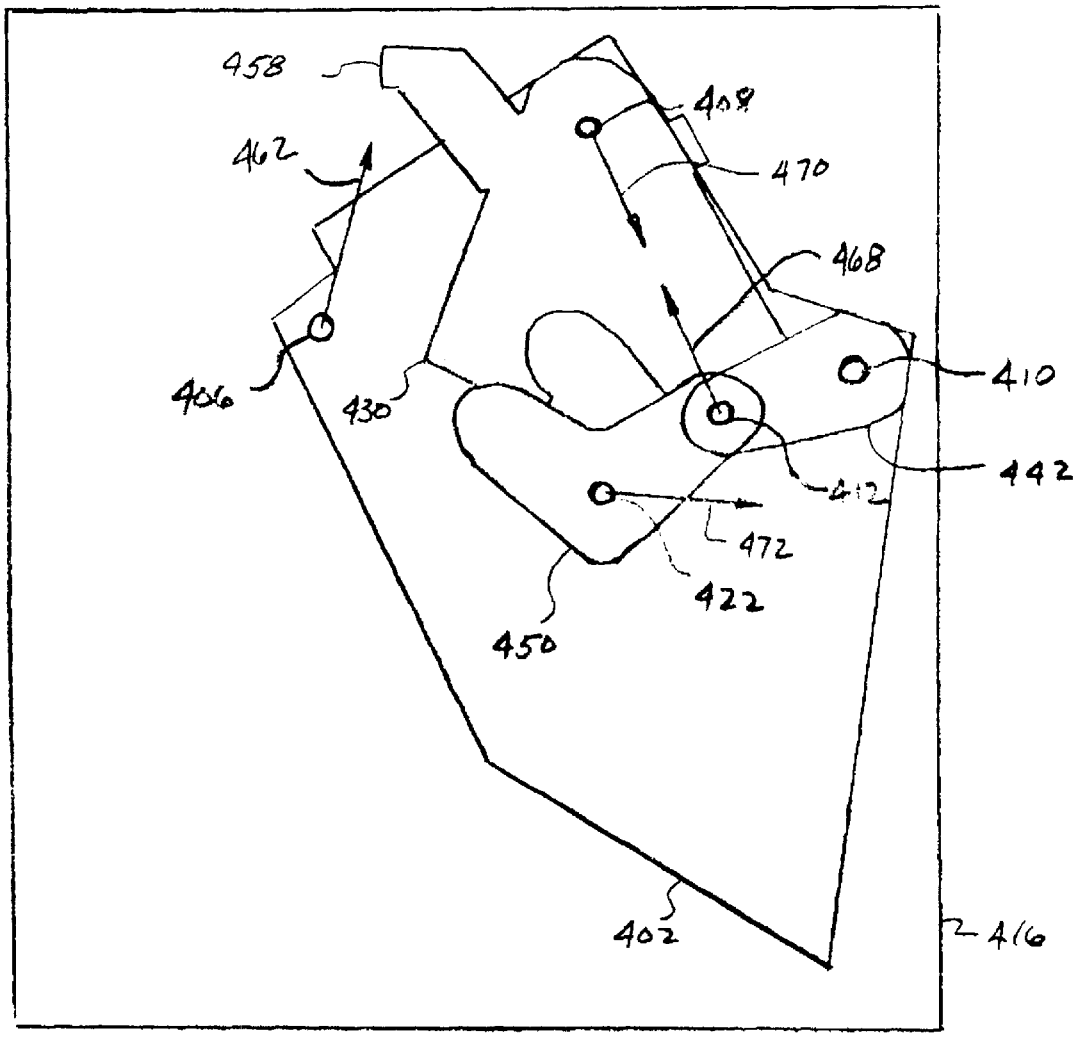
FIG. 23 is a force and moment diagram of the circuit breaker motor operator of FIG. 8.

The mechanical linkage system 400 thence comes to rest in the configuration of FIG. 12. In proceeding from the configuration of FIG. 8 to that of FIG. 12, the main spring 302 is compressed a distance "x" by the drive plate pin 406 due to the counterclockwise rotation of the drive plates 402 about the drive plate axis 408. The compression of the main spring 302 thus stores energy in the main spring 302 according to the equation $E=\frac{1}{2} k_m X^2$, where x is the displacement of the main spring 302. The motor operator 200, the energy storage mechanism 300 and the mechanical linkage system 400 are held in the stable position of FIG. 12 by the first latch link 442, the second latch link 450 and the latch plate 430. The positioning of the first latch link 442 and the second latch link 450 with respect to one another and with respect to the latch plate 430 and the cam 420 is such as to prevent the expansion of the compressed main spring 302, and thus to prevent the release of the energy stored therein. As seen in FIG. 23, this is accomplished due to the fact that although there is a force acting along the line 462 caused by the compressed main spring 302, which tends to rotate the drive plates 402 and the first latch link 442 clockwise about the drive plate axis 408, the cam shaft 422 is fixed with respect to the side plates 416 which are in turn affixed to the molded case circuit breaker 100. Thus, in the configuration FIG. 12 the first latch link 442 and the second latch line 450 form a rigid linkage. There is a tendency for the linkage of the first latch link 442 and the second latch link 450 to rotate about the link axis 412 and collapse. However, this is prevented by a force acting along the line 470 countering the force acting along the line 468. The reaction force acting along line 472 at the cam shaft counters the moment caused by the spring force acting along line 462. Thus forces and moments acting upon the motor operator 200 in the configuration of FIG. 12 are balanced and no rotation of the mechanical linkage system 400 may be had.

In FIG. 12 the molded case circuit breaker 100 is in the open position. To proceed from the configuration of FIG. 12 and return to the configuration of FIG. 8 (i.e., electrical contacts closed), a force is applied to the latch plate 430 on the latch plate lever 458 at 460. The application of this force acts so as to rotate the latch plate 430 counterclockwise about the drive plate axis 408 and allow the rolling pin 446 to move from the first concave surface 434 as in FIG. 12 to the second concave surface 436 as in FIG. 8. This action releases the energy stored in the main spring 302 and the force acting on the drive plate pin 406 causes the drive plate 402 to rotate clockwise about the drive plate axis 408. The clockwise rotation of the drive plate 402 applies a force to the circuit breaker handle 102 at the second retaining bar 208 throwing the circuit breaker handle 102 leftward, with the main spring 302, the latch plate 430 and the mechanical linkage system 400 coming to rest in the position of FIG. 8.

Figure 22:
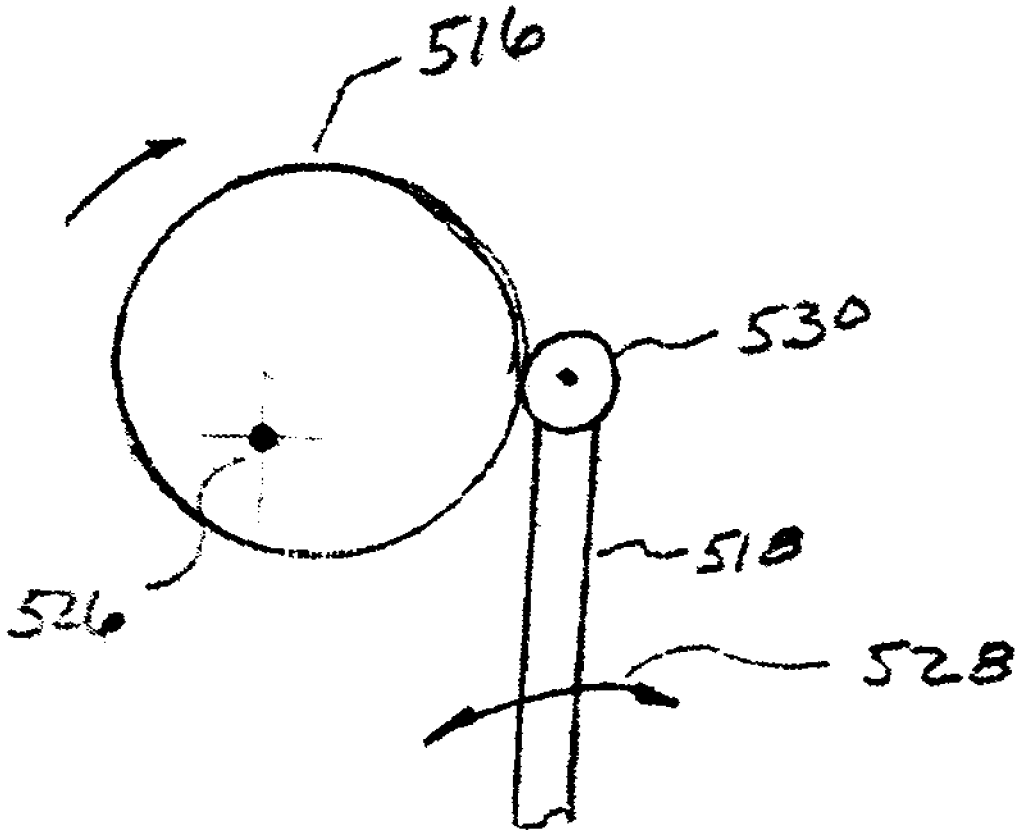
FIG. 22 is a view of the ratcheting mechanism of the motor drive assembly of the circuit breaker motor operator of FIG. 8.

Referring to FIG. 21, the motor drive assembly 500 is shown engaged to the motor operator 200, the energy storage mechanism 300 and the mechanical linkage system 400. The motor drive assembly 500 comprises a motor 502 geared to a gear train 504. The gear train 504 comprises a plurality of gears 506, 508, 510, 512, 514. One of the gears 514 of the gear train 504 is rotatable about an axis 526 and is connected to a disc 516 at the axis 516. The disc 516 is rotatable about the axis 526. However, the axis 526 is displaced from the center of the disc 516. Thus, when the disc 516 rotates due to the action of the motor 502 and gear train 504, the disc 516 acts in a cam-like manner providing eccentric rotation of the disc 516 about the axis 526. The motor drive assembly 500 further comprises a unidirectional bearing 522 coupled to the cam shaft 422 and a charging plate 520 connected to a ratchet lever 518. A roller 530 is rotatably connected to one end of the ratchet lever 518 and rests against the disc 516 (FIG. 22). Thus, as the disc 516 rotates about the axis 526, the ratchet lever 518 toggles back and forth as seen at 528 in FIG. 22. This back and forth action ratchets the unidirectional bearing 522 a prescribed angular displacement, θ, about the cam shaft 422 which in turn ratchets the cam 420 by a like angular displacement. Referring to FIG. 20, the motor drive assembly 500 further comprises a manual handle 524 coupled to the unidirectional bearing 522 whereby the unidirectional bearing 522, and thus the cam 420, may be manually ratcheted by repeatedly depressing the manual handle 524.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An energy storage mechanism for a circuit breaker motor operator, the energy storage mechanism comprising:

a first elastic member;

a first fixture having a plurality of slots therein, the first fixture positioned in the first elastic member;

a second fixture having a plurality of members defining an aperture;

a second elastic member engaged to the second fixture and positioned within the aperture;

wherein the second fixture is engaged to the first fixture such that the second elastic member is compressible to axially slide the first fixture with respect to the second fixture and such that the first elastic member is compressible without axially sliding the first fixture with respect to the second fixture.

2. The energy storage mechanism as set forth in claim 1 further comprising a flange affixed to the first fixture.

3. The energy storage mechanism as set forth in claim 2 further comprising a locking member for securing the first elastic member between the locking member and the flange.

4. The energy storage mechanism as set forth in claim 1 wherein the second fixture is operative to slide a prescribed distance relative to the first fixture.

5. The energy storage mechanism as set forth in claim 1 wherein the first elastic member comprises a spring having a first spring constant.

6. The energy storage mechanism as set forth in claim 5 wherein the second elastic member comprises a spring having a second spring constant less than the first spring constant.

7. The energy storage mechanism as set forth in claim 4 wherein the plurality of slots includes a receptacle in one end of the first fixture for receiving a member about which the energy storage mechanism is rotatable.

8. The energy storage mechanism as set forth in claim 7 wherein the energy storage mechanism is capable of moving free of the member after having moved the prescribed distance.

9. The energy storage mechanism as set forth in claim 1, wherein a beam member of the second fixture is engaged with, and allowed to move along the length of, a respective one of the plurality of slots of the first fixture.

10. An energy storage mechanism for a circuit breaker motor operator, comprising:

a first spring guide;

a second spring guide, said second spring guide being slidably attached with said first spring guide between a use position and a replacement position, the energy storage mechanism being connectable with the circuit breaker motor operator in said use position and being disconnectable from the circuit breaker motor operator in said replacement position;

means for biasing said first spring guide and said second spring guide to said use position; and means for storing energy engaged about said first spring guide, said means for biasing being dimensioned, positioned and configured to be compressible to slide said first spring guide and said second spring guide to said replacement position without compression of said means for storing energy, and said means for storing energy being dimensioned, positioned and configured to be compressible by said circuit breaker motor operator without sliding said second spring guide and said first spring guide from use position.

11. The energy storage mechanism of claim 10, wherein said means for biasing has a first spring constant, and said means for storing energy has a second spring constant, said first spring constant being smaller than said second spring constant.

12. The energy storage mechanism of claim 11, wherein said means for biasing said first spring guide and said second spring guide to said use position is a spring.

13. The energy storage mechanism of claim 12, wherein said spring is a coil spring.

14. The energy storage mechanism of claim 11, wherein said means for storing energy is a coil spring disposed about said first spring guide.

15. The energy storage mechanism of claim 14, wherein said spring is a coil spring.

* * * * *